United States Patent [19]

Valiulis

[11] Patent Number: 4,560,062

[45] Date of Patent: Dec. 24, 1985

[54] METHOD AND APPARATUS FOR SUPPORTING A DISPLAY CARTON

[75] Inventor: Stanley C. Valiulis, Rockford, Ill.

[73] Assignee: Southern Imperial, Inc., Rockford, Ill.

[21] Appl. No.: 685,455

[22] Filed: Dec. 24, 1984

[51] Int. Cl.[4] ..... B65D 5/44; B65D 33/14

[52] U.S. Cl. ..... 206/44 R; 206/806; 248/220.3; 248/220.4; 229/52 AW

[58] Field of Search ..... 206/44 R, 45.31, 806; 229/52 AW; 248/220.3, 220.4

[56] References Cited

U.S. PATENT DOCUMENTS

| | | | |
|---|---|---|---|
| 2,812,852 | 11/1957 | Samuels | 206/44 R |
| 2,977,148 | 3/1961 | Ford | 206/497 |
| 3,027,036 | 3/1962 | Burreck | 215/100 R |
| 3,092,302 | 6/1963 | McDermott | 229/52 AW |
| 3,148,770 | 9/1964 | Cosman | 206/806 |
| 3,570,665 | 3/1971 | Houston et al. | 206/806 |
| 4,020,947 | 5/1977 | Roccaforte | 206/806 |
| 4,213,559 | 7/1980 | Meyers | 206/806 |

*Primary Examiner*—William T. Dixson, Jr.

*Attorney, Agent, or Firm*—Leydig, Voit & Mayer, Ltd.

[57] ABSTRACT

An elongated hanger of the "Pegboard" type is packaged with loose hardware in a paperboard carton by the supplier of the hardware. Upon receiving the carton, a retailer removes the outer and upper end portion of the carton to form a display and access opening in the carton, removes the hanger from the carton through the opening, attaches the hanger to an upright display panel and then suspends the carton from the hanger by causing the hanger to telescope into the inner end of the carton and to underlie the upper wall thereof. In this way, the merchandise is displayed in an open carton which is supported in outwardly extending relation from the display panel by the hanger.

4 Claims, 5 Drawing Figures

FIG. 1
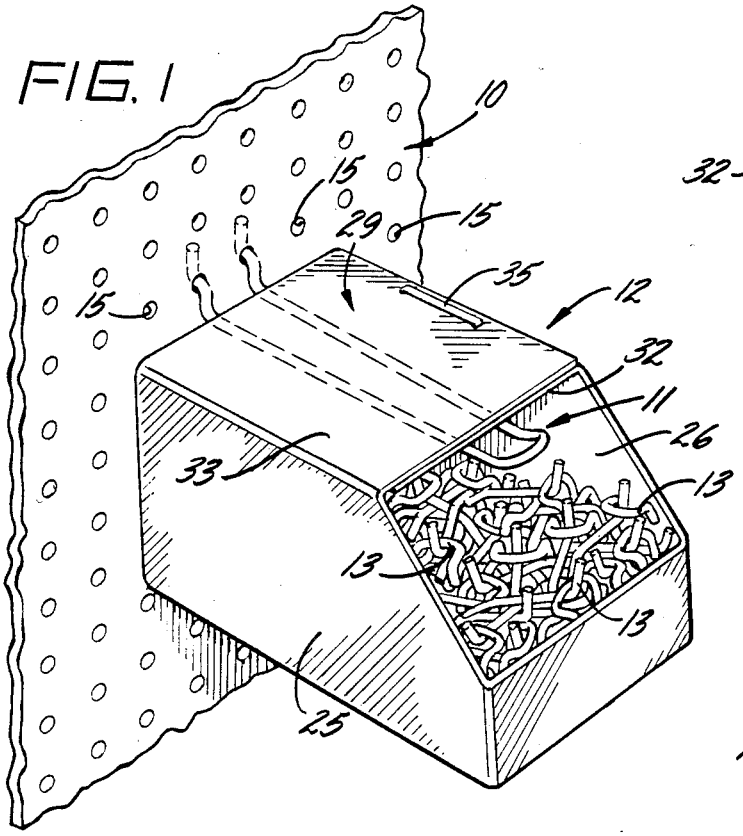
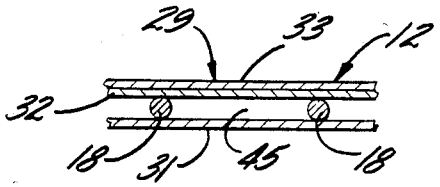
FIG. 5
FIG. 3
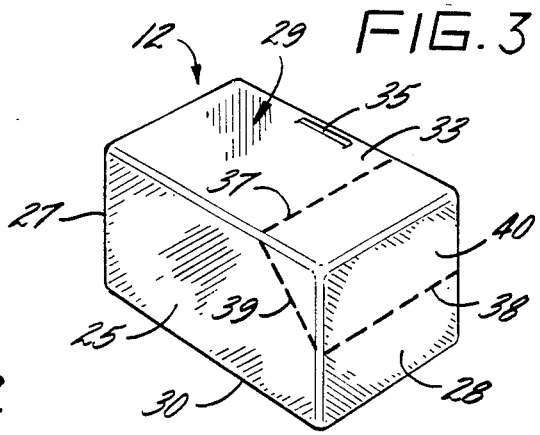
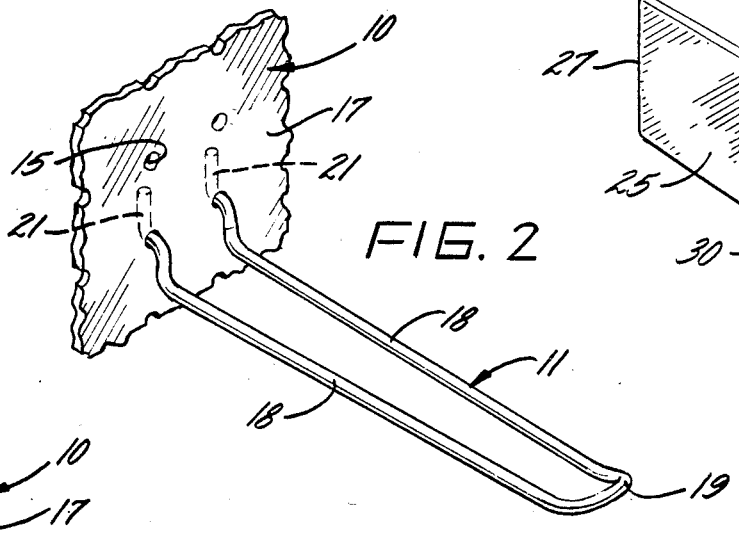
FIG. 2
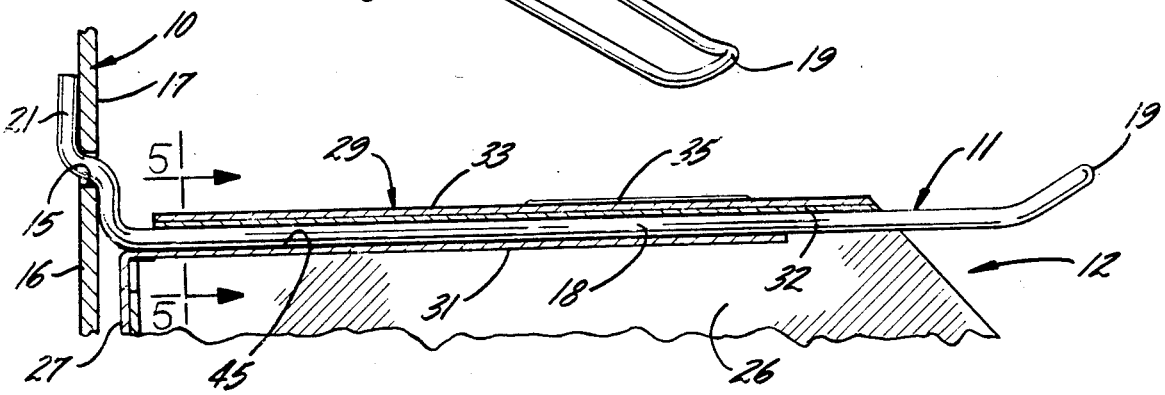
FIG. 4

METHOD AND APPARATUS FOR SUPPORTING A DISPLAY CARTON

BACKGROUND OF THE INVENTION

This invention relates generally to the display of merchandise and, more particularly, to the retail display of loose merchandise which is packaged and shipped in a paperboard carton.

Merchandise such as screws, wire hooks and other hardware often is packaged loose in bulk quantities (e.g., 100 pieces) in sturdy paperboard cartons for shipment to a retailer. Upon receiving the carton, the retailer opens the carton to expose the loose merchandise and displays the merchandise simply by placing the open carton on a display shelf. This method of merchandising is not particularly attractive, convenient or flexible and can require a comparatively large amount of shelf space.

SUMMARY OF THE INVENTION

The general aim of the present invention is to display a carton of merchandise in a unique manner enabling the carton to hang cantilever fashion from an upright display panel so that the carton need not rest on a shelf and so that a more attractive and flexible display may be created.

A further object of the invention is to use an outwardly extending hanger similar to a "Pegboard" hook to support a carton in outwardly extending relation from an upright perforated panel similar to a "Pegboard" panel.

Still another object is to uniquely package the hanger in the carton itself with the merchandise so that the retailer may subsequently use the hanger to support the carton from the panel after the carton has been opened to expose the merchandise.

These and other objects and advantages of the invention will become more apparent from the following detailed description when taken in conjunction with the accompanying drawings.

BRIEF DESCRIPTION OF THE DRAWINGS

FIG. 1 is a perspective view of an open display carton supported by a hanger which is attached to a perforated panel.

FIG. 2 is a perspective view of the panel and the hanger prior to placing the carton on the hanger.

FIG. 3 is a perspective view of the carton prior to opening of the carton.

FIG. 4 is a cross-sectional view taken longitudinally through the hanger and carton of FIG. 1.

FIG. 5 is a fragmentary cross-section taken substantially along the line 5—5 of FIG. 4.

DETAILED DESCRIPTION OF THE PREFERRED EMBODIMENT

The present invention involves three basic elements, namely, an upright display panel 10, an elongated hanger 11 and a display carton 12. Herein, the display carton contains a large number of loose hardware items such as, for example, hooks 13.

The display panel 10 is of conventional construction and includes several vertically spaced rows of horizontally spaced holes 15 extending between the inner and outer faces 16 and 17 of the panel. Thus, the present panel is similar to a "Pegboard" panel.

Also, the hanger 11 is of the type conventionally known as a "loop hook". Such a hanger includes a pair of horizontally spaced wire arms 18 (FIG. 2) integrally joined to an outer wire bridge 19 and defining a U-shaped configuration when viewed from above. Formed integrally with the inner ends of the arms are two generally upright fingers or horns 21 (FIG. 4). The horns are adapted to be inserted horizontally through two adjacent horizontally spaced holes 15 of the panel 10 and then lock against the inner face 16 of the panel to hold the hanger 11 in outwardly extending relation from the panel.

A typical carton 12 as filled and closed by the supplier of the hooks 13 is shown most clearly in FIG. 3. Such a carton is of rectangular cross-section and comprises a pair of upright side walls 25 and 26, inner and outer walls 27 and 28 and upper and lower walls 29 and 30. The particular construction of the carton may vary widely and thus only those portions of the carton which have significance to the present invention will be described in detail. One of the more significant portions is the upper wall 29 which herein is formed by three flaps 31, 32 and 33. The flap 31 (FIGS. 4 and 5) is a lower flap which is hinged to the upper end of the inner wall 27 and which extends outwardly over the open space of the carton. The flap 32 is hinged to the upper end of the side wall 26 and is folded laterally over the flap 31. Finally, the flap 33 is hinged to the upper end of the side wall 25 and is folded over the flap 32. A rather large staple 35 adjacent the side wall 26 fastens the free end portion of the flap 33 to the hinged end portion of the flap 32 to hold the carton 12 closed. More than one staple may be used to secure the flaps in a closed position or the top flap 33 may be secured by an integrally formed tab or by other means known in the carton art.

The other somewhat significant portion of the present carton 12 involves the upper and outer portion of the carton. As shown in FIG. 3, horizontal lines 37 and 38 are formed across the outer end portion of the upper carton wall 29 and across the upper end portion of the outer wall 28. The lines 37 and 38 are connected by lines 39 (only one of which is visible) extending diagonally of the upper and outer corners of the side walls 25 and 26. By cutting along the lines 37 to 39 with a knife, the retailer may cut away a generally triangular section 40 from the upper and outer portion of the carton to form a display and access opening in the carton. FIGS. 1 and 4 show the carton with the upper and outer portion cut away to form an opening permitting the hooks 13 to be seen and to be removed from the carton. It will be noted that the cut is made outwardly of the staple 35 so that the staple continues to hold the inner portion of the upper carton wall 29 securely closed. In certain cartons, the lines 37 to 39 may be perforated to enable the upper and outer portion 40 of the carton to be torn away without the use of a knife. Also, the carton may be constructed so that the outer wall 28 remains intact and so that only the outer portion of the upper wall 29 is removed to open the carton.

In accordance with the present invention, the open carton 12 is supported in outwardly extending relation from the panel 10 by the hanger 11. Thus, as shown in FIGS. 4 and 5, the arms 18 of the hanger 11 are inserted into the gap 45 between the upper end of the inner wall 27 and the intermediate flap 32 of the upper wall 29 and, in this particular instance, substantial lengths of the arms are located between the flaps 31 and 32 with the extreme outer end portion 19 of the hanger projecting outwardly beyond the outer end of the upper wall 29. Accordingly, the arms 18 are disposed in underlying engagement with the flap 32 of the upper wall 29 and are disposed in overlying engagement with the upper end of the inner end wall 27 and the upper side of the flap 31. Since the flaps 32 and 33 are secured in a closed position by the staple 35, the carton 12 hangs from the hanger 11 and enables the hooks 13 to be displayed from the panel rather than from a carton resting on a shelf. The hanger may be attached to the panel at any appropriate or convenient position.

In the preferred manner of carrying out the invention, a hanger 11 is placed loose inside the carton 12 with the hooks 13 by the hardware supplier prior to closing and stapling of the carton. When the retailer receives the carton and opens the outer and upper portion thereof, the hanger is taken out of the carton through the opening and is used to support the carton from the panel 10. The hanger may be telescoped with the carton either prior to or after attachment of the hanger to the panel, it usually being more convenient to attach the hanger to the panel and then to suspend the carton from the hanger by telescoping the carton onto the outwardly extending hanger.

I claim:

1. The combination of:

A. an upright display panel having inner and outer faces and having horizontally spaced holes extending between said inner and outer faces;

B. an outwardly extending hanger having two horizontally spaced arms connected at their outer ends and defining a generally U-shaped configuration when viewed from above, said hanger including means on the inner ends of said arms and projecting through said holes to attach said hanger to said panel; and C. a carton of rectangular cross-section for holding and displaying merchandise, said carton having two upright side walls, having upper and lower walls and having inner and outer walls, the outer end of the upper wall being spaced inwardly by a substantial distance from the upper end of said outer wall to leave a merchandise display and access opening at the upper and outer portion of said carton, said upper wall being secured against being opened relative to said side walls, and there being a vertically narrow gap between the lower face of said upper wall and the upper end of said inner wall, said combination being characterized in that said hanger arms extend outwardly through said gap in overlying relation with the upper end of said inner wall and in underlying engagement with the lower face of said upper wall to support said carton on said hanger in outwardly extending relation from said panel.

2. The combination defined in claim 1 in which the inner end portion of the upper wall of said carton is defined by a pair of vertically spaced and generally horizontal flaps, said hanger arms being located between said flaps.

3. The combination defined in claim 1 in which said carton includes edges extending horizontally along the upper end of said outer wall and along the outer end of said upper wall and extending diagonally of said side walls, the diagonal edges of said side walls extending between the horizontal edges of said outer and upper walls and coacting therewith to define said display and access opening.

4. A method of packaging and displaying merchandise, said method comprising the steps of:

A. placing merchandise in an open carton which, when closed, is of generally rectangular cross-section and has two upright side walls, upper and lower walls and inner and outer walls;

B. placing in the open carton an elongated hanger having means on the inner end thereof for attaching the hanger removably to an upright panel in outwardly extending relation therewith;

C. closing the carton to enclose the merchandise and the hanger therein, the inner end portion of the upper wall being secured relative to the side walls of the closed carton and being spaced upwardly from the upper end of the inner wall;

D. subsequently creating a display and access opening in the carton by removing an outer end portion of the upper wall while leaving said inner end portion of said upper wall secured relative to said side walls;

E. removing said hanger from said carton through said opening and attaching said hanger to an upright panel with said means; and F. telescoping said hanger with said carton by inserting said hanger into the space between the inner end portion of said upper wall and the upper end of said inner wall to cause said hanger to be disposed in underlying supporting engagement with the lower face of said upper wall, said telscoping taking place either prior to or after attachment of said hanger to said panel whereby said hanger supports said carton in outwardly extending relation with said panel after both said telescoping and said attachment have been effected.

* * * * *